US006254447B1

(12) United States Patent
Niemann

(10) Patent No.: US 6,254,447 B1
(45) Date of Patent: Jul. 3, 2001

(54) SELF-ACTING FLOTATION DEVICE FOR FLOTATION LIFE PRESERVERS

(76) Inventor: Wolfgang Niemann, Relphfad 3, D-21220 Seevetal (DE)

( * ) Notice: Subject to any disclaimer, the term of this patent is extended or adjusted under 35 U.S.C. 154(b) by 0 days.

(21) Appl. No.: 09/523,714

(22) Filed: Mar. 13, 2000

(30) Foreign Application Priority Data

Mar. 13, 1999 (DE) ..... 299 04 651
Aug. 18, 1999 (DE) ..... 299 14 503

(51) Int. Cl.[7] ..... B63C 9/125

(52) U.S. Cl. ..... 441/101; 441/93; 222/5; 222/80; 222/154

(58) Field of Search ..... 441/42, 92, 93, 441/94, 96, 101, 41; 222/3, 5, 23, 80, 81, 154

(56) References Cited

U.S. PATENT DOCUMENTS 3,426,942 * 2/1969 McMains et al. ..... 222/5
3,675,722 * 7/1972 Balmes, Sr. ..... 169/30
3,997,079 * 12/1976 Niemann ..... 222/5
4,927,057 * 5/1990 Janko et al. ..... 222/5
5,035,345 * 7/1991 Janko et al. ..... 222/5
5,333,656 * 8/1994 Mackal ..... 141/330
5,413,247 * 5/1995 Glasa ..... 222/5
5,509,576 * 4/1996 Weinheimer et al. ..... 222/5
5,562,233 * 10/1996 Glasa ..... 222/5
5,597,091 * 1/1997 Mah et al. ..... 222/3
5,643,030 * 7/1997 Brown ..... 441/94
6,004,177 * 12/1999 Biesecker et al. ..... 441/92

* cited by examiner

*Primary Examiner*—S. Joseph Morano
*Assistant Examiner*—Ajay Vasudeva
(74) *Attorney, Agent, or Firm*—Robert W. Becker & Associates

(57) ABSTRACT

An inflation device is provided which is inflatable upon impact by water for marine flotation life preservers, wherein the tip of a striking pin is moved by means of a plunger which is driven by igniting a pyrotechnic charge in the direction of the sealing membrane of a pressure gas cartridge and against the force of a spring, and wherein the tip of the striking pin and the sealing membrane are of electrically conducting material, and wherein during a ready position of the device, the tip of the striking pin bears against the sealing membrane of the pressure gas cartridge and wherein the tip and the sealing membrane are in electrical connection with an indicator unit to form a closed electrical circuit, whereby the presence of an intact sealing membrane of the pressure gas cartridge, or the absence thereof, is detectable.

14 Claims, 2 Drawing Sheets

SELF-ACTING FLOTATION DEVICE FOR FLOTATION LIFE PRESERVERS

BACKGROUND OF THE INVENTION

The present invention relates to an inflation device for flotation life preservers, and in particular to a device of the type which is automatically activated upon impact by water.

Inflation devices of this type are normally used for inflatable marine life preservers, in particular for use in life vests or collars of such type that when an emergency arises, they are capable of automatic inflation upon immersion in water. This type of inflation device is particularly needed where the person who is wearing, for example, a life vest, is prevented or unable to manually activate the inflation step in order to inflate the vest.

From the prior art, an inflation device of the aforementioned type is, for example, known from German Patent DE 41 06 435 A1. The functional capacity and/or the state of readiness of this type of device can only be ascertained upon removal of the pressure gas cartridge and then visual inspection of the cartridge and/or the pyrotechnic charge, which are present in such devices. Needless to say, such an inspection, aside from being time consuming and costly, is virtually impossible to be carried out during an emergency when the urgent need arises to put the life saving device into action. Thus, there is the danger that without a prior checking of the state of readiness of the device, a non-functional life preserver is utilized, which can have catastrophic consequences.

SUMMARY OF THE INVENTION

It is thus an object of the present invention to provide an improved self-acting inflation device useful for life preservers, obviating the afore-stated drawbacks.

In particular, it is an object of the present invention to provide an improved self-acting inflation device for floating life preservers, which inflation device is activated upon impact by water and which permits easy detection of its functional readiness at any time.

These objects, and others which will become apparent hereinafter, are attained in accordance with the present invention, wherein a self-acting inflation device has a pyrotechnic charge, a trigger and ignition mechanism for firing the pyrotechnic charge, a pressure gas cartridge which has a sealing membrane across an opening, a striking pin provided with a tip proximate to the sealing membrane of the pressure gas cartridge, a plunger which moves the striking pin when the pyrotechnic charge is ignited thereby driving the striking pin against the force of a spring in the direction at the sealing membrane for puncturing it, and wherein the tip and the sealing membrane are from electrically conducting material, and wherein in a ready position, the tip of the striking pin bears against the sealing membrane to form an electrical connection and wherein the tip of the striking pin on the one hand and the sealing membrane on the other hand are electrically connected to an indicator unit such that a closed electrical circuit with the tip and the membrane is formed which is shown by the indicator unit and wherein the detection of an intact membrane indicates the presence of a pressure gas cartridge and the ready condition of the device.

If the sealing membrane is no longer detected because no pressure gas cartridge is present or the sealing membrane is punctured as in the case when the pressure gas cartridge is empty, the electrical circuit is interrupted, as the striking pin after puncturing the sealing membrane retracts the pin to its original position due to the spring action. When this occurs, the tip of the striking pin no longer touches the membrane and thus the indicator unit can no longer indicate the presence of a closed circuit whereby the lack of an intact pressure gas cartridge can be immediately detected.

Suitably, the indicator unit is configured such that monitoring of the presence of a pressure gas cartridge with an intact sealing membrane or the absence thereof occurs in a continuous manner or, alternatively, the indicator unit incorporates suitable switching means which detects, for example, the presence of a pressure gas cartridge upon manual activation of the switch.

An advantage of the former type of indicator unit is that the presence of the pressure gas cartridge can be monitored by a visual inspection when walking past the life preserver, although higher energy consumption is associated with this continuous monitoring. With the latter type of indicator, energy consumption is markedly reduced. In both cases, however, inspection of the inflation device to check the life preserver's readiness can be carried out quickly and if necessary can be even done shortly before the life preserver needs to be used.

In another embodiment of the device according to the invention, the tip of the striking pin is flattened such that a larger surface for electrical contact between the sealing membrane and the tip is realized, thus increasing, among other things, a good contact and thus reliability of an indicator reading. An added advantage of the flatter tip is furthermore that it is less likely that the tip, which in the ready position bears against the sealing membrane, works its way into the membrane such that the membrane may be inadvertently and prematurely punctured. In a further variation, the tip is configured in the shape of a truncated cone or truncated pyramid having an angle of preferably approximately 45°. Such configuration ensures that following puncturing of the membrane, the retracted tip does not come into contact with sections of the sealing membrane, which may have remained around the edge of the opening.

Furthermore, the tip of the striking pin may be spring mounted when biased against the membrane. With the spring element, by which the tip of the striking pin is biased against the membrane, a steady electrical contact between the tip and the intact membrane is realized, thereby further increasing the reliability of the indicator reading.

In a further embodiment of the invention the indicator unit is integrated into the trigger and ignition mechanism for the pyrotechnic charge. Such integration facilitates a more compact configuration of the device. The trigger and ignition mechanism may be provided with an electrical switch, which can be activated by water. Advantageously, the electrical switch is provided with two contact points, which are located at some distance from each other and between which an electrical contact can be made by water. A protecting wall disposed between the two contacts is designed to prevent leaking currents. This arrangement prevents the inflation device from being prematurely set off, for example by splashing water, condensed humidity or condensation water.

In a preferred embodiment of the invention, the trigger and ignition mechanism is provided with a test switching circuit and with an indicator unit whereby the pyrotechnic charge can be supplied with a testing current or a testing voltage, which is designed not to lead to ignition but to detect the presence or absence of an intact pyrotechnic charge.

Furthermore, the test switching circuit and the electric circuitry for detecting the integrity of the sealing membrane can be designed to operate together with the same indicator unit so as to reduce the space needed for separate test switches. The indicator unit can be designed as a simple indicator light, for example an LED, which is lit up when the device is ready to operate. The test switching circuit and the electric circuitry for monitoring the sealing membrane can also be connected serially, because the life preserver is useless when there is no intact sealing membrane present; on the other hand, the device cannot be self-acting when the pyrotechnic charge is either defective or absent. However, separate indicator units can also be used for checking each function. This has the added advantage that, for example, a life preserver, in which only the pyrotechnic charge of the inflation device is defective, can still be used when manually activated.

It is however useful that testing of the pressure gas cartridge and testing of the pyrotechnic charge is carried out by operation of the same switching means to thus simplify the handling of the testing steps.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
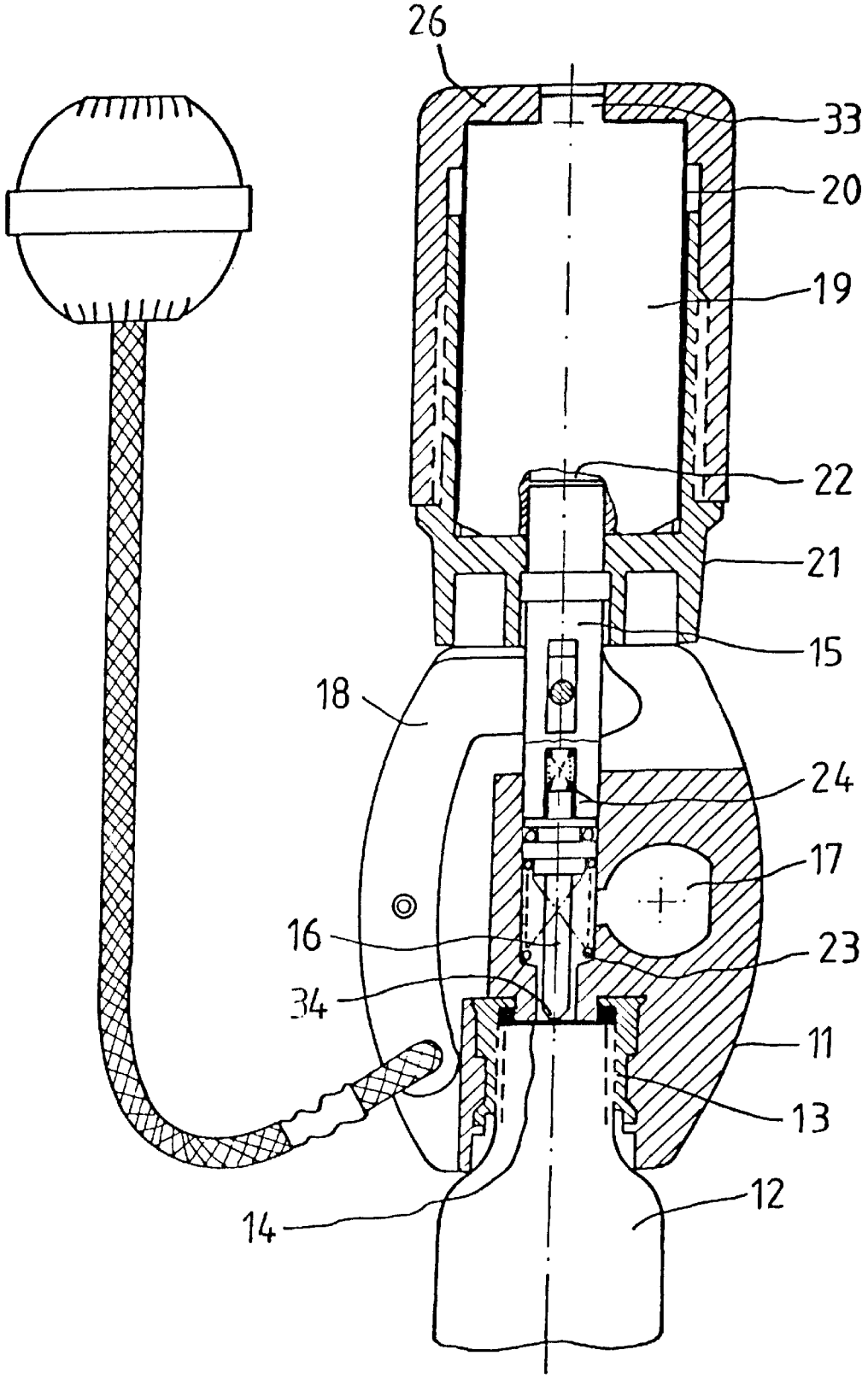
FIG. 1 is a sectional view along a longitudinal axis of an inflation device in a ready position according to the present invention.
Figure 2:
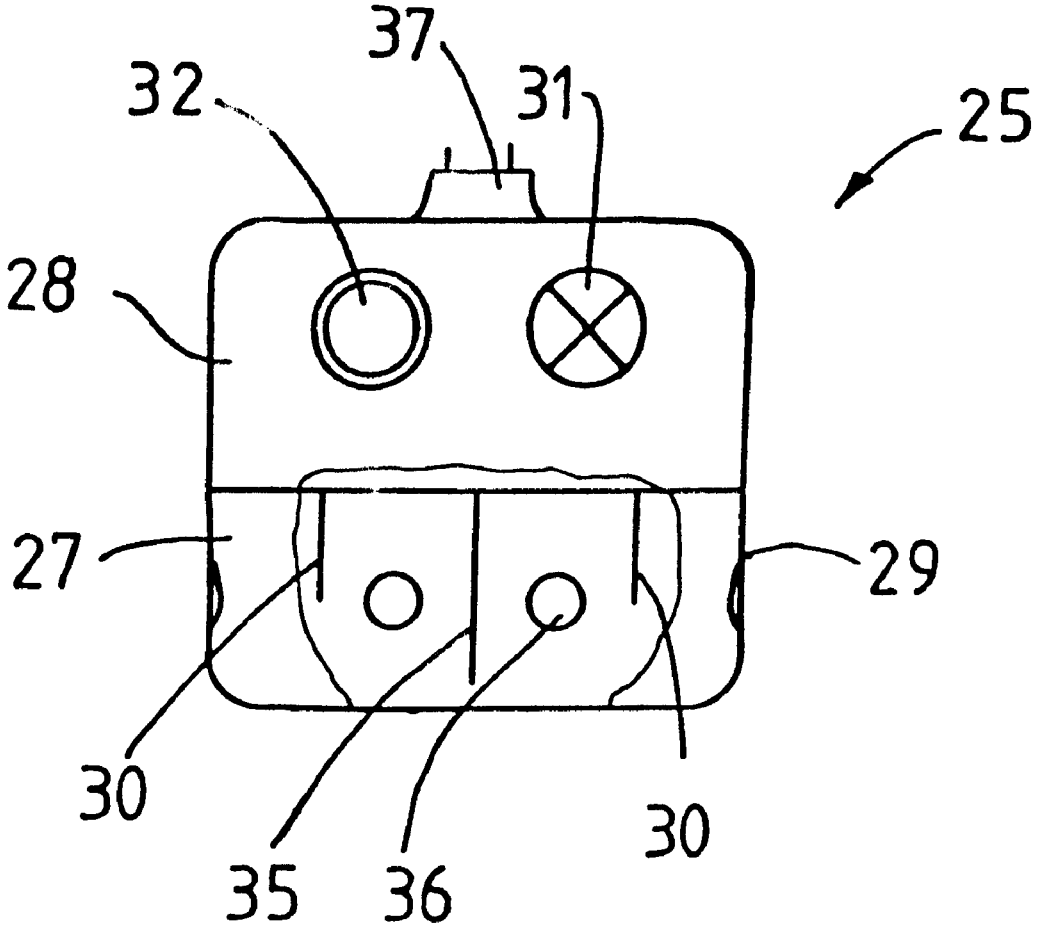
FIG. 2 is a view of the trigger and ignition mechanism showing a partial cut-away section.

Throughout all the figures, same or corresponding elements are generally indicated by the same reference numerals.

Turning now to the drawing, and in particular to FIG. 1, there is shown an inflation device with the lower housing part 11 having a screw receiving thread 13 for receiving a pressure gas cartridge 12. The pressure gas cartridge 12 is sealed by a sealing membrane 14. In the lower part of the housing 11, a striking pin 15 is movably disposed. The striking pin impacts upon a striking pin tip 16 in the direction of the sealing membrane 14 which it punctures, whereby the cartridge is opened and the gas from the pressure gas cartridge flows through a channel 17 into the inflatable life preserver which is not shown here.

The striking pin 15 may be operated manually by means of a lever mechanism 18, which lever mechanism is conventionally known and therefore not described here in detail. Alternatively, the device carries a pyrotechnic charge 19 which when ignited moves the striking pin 15 in the direction of the sealing membrane 14. The pyrotechnic charge 19 is disposed in a cartridge 20, which is held in the upper housing part 21 of the inflation device by means of a screw cap 26. The ready-made cartridge 20 is provided with a plunger 22 for impacting upon the striking pin 15. As shown in FIG. 1, the striking pin 15 is held in ready position by means of a restoring spring 23. The tip 16 of the striking pin is configured in the shape of a truncated cone or truncated pyramid such that a flattened area 34 of the tip 16 bears directly against the sealing membrane 14.

In a ready position, the tip 16 of the striking pin 15 touches the sealing membrane 14. Thus, the tip 16 is held in position against the action of the restoring spring 23, and bears against the sealing membrane 14 by means of spring element 24, wherein the spring element is configured as a compression spring, which abuts the striking pin 15. The tip 16 of the striking pin 15 and the sealing membrane 14 are in electrical connection with an indicator unit, thereby forming a testing circuitry by which the presence of an intact sealing membrane and thus an intact pressure gas cartridge can be monitored. In particular, the thread 13 and all other housing parts are also configured as either electrically conducting, or electrically insulating, against each other in order to maintain the testing circuitry.

The pyrotechnic charge 19 is set off by means of a trigger and ignition mechanism 25, which is activated upon impact by water. The trigger and ignition mechanism 25 is electrically connected with the connector 33 of the cartridge 20. The trigger and ignition mechanism 25 may also, by means of connector 37, be plugged directly on top of the cartridge 20 and the upper housing part 21.

The trigger and ignition mechanism 25 is disposed within a housing, which comprises two chambers 27 and 28. An electrical switch 29, which can be activated by water, is disposed in chamber 27, while in chamber 28, the electronic parts that are not further described here, as well as the batteries or storage batteries for the test circuitry and the ignition current for igniting the pyrotechnic charge 19, are disposed. Chamber 28 is preferably waterproof.

The switch 29 which is activated by water has electrical contacts 30, which when contacted by the water flowing into the chamber 27 via openings 36 establish an electrical connection. A separating wall 35 is disposed between the contacts 30 in such a manner that the separating wall does not entirely extend to the chamber wall in order to prevent leaking currents which might inadvertently trigger the inflation device.

The electronics of the trigger and ignition mechanism 25 comprises additionally a test circuitry, which admits a test voltage or a test current to the pyrotechnic charge 19 and by which no ignition of the pyrotechnic charge is effected, but by which the presence or absence of an ignitable pyrotechnic charge is detectable. The test switching circuit can thus be in operative connection with electronic elements which are connected to the switch 29 and which are triggered by water impact, such that the necessary ignition voltage or ignition current is switched only under the influence of water.

Furthermore, the test circuitry for the sealing membrane 14 is integrated into the trigger and ignition mechanism 25. Indicator means are provided to indicate the respective status of readiness of the inflation device. The indicator means are configured as conventional LEDs 31. Additionally, switching means, for example a key 32, may be provided, which is designed for either simultaneous or successive checking of the various parts of the device.

Other variations, modifications and structural changes of the device as set forth above are within the realm of persons skilled in the art. Specifically, the spring element that biases the tip of the striking pin in the direction of the sealing membrane of the pressure gas cartridge can be configured as a disc or a ring of elastic material, disposed between the striking pin and the tip of the striking pin.

It is obvious that this configuration of an inflation device facilitates the control of its functional state or state of readiness. In particular, the inflation device need not be taken apart in order to examine its readiness state. Pressing a key, thereby preventing the use of an obviously defective life preserver, can thus carry out testing the readiness of the device virtually instantaneously.

While the invention has been illustrated and described as embodied in an inflation device for a life preserver, it is not intended to be limited to the details shown since various modifications and structural changes may be made without departing in any way from the spirit of the present invention.

The specification incorporates by reference the disclosure of German priority documents 299 04 651.6 of Mar. 13, 1999 and 299 14 503.4 of Aug. 18, 1999.

The present invention is, of course, in no way restricted to the specific disclosure of the specification and drawings, but also encompasses any modifications within the scope of the appended claims.

What I claim is:

1. A self-acting inflation device for floating life preservers which activates upon impact of water, comprising:

a pyrotechnic charge, a striking pin provided with a tip for puncturing a sealing membrane of a pressure gas cartridge, and a plunger capable of driving the striking pin against the force of a spring in the direction at the sealing membrane when the pyrotechnic charge is ignited by means of a trigger and ignition mechanism;

wherein said striking pin tip and said sealing membrane are of electrically conducting material, and wherein during a ready position of the inflation device, the tip of the striking pin bears against the sealing membrane of the pressure gas cartridge and wherein the tip of the striking pin and the sealing membrane thus form an electrical circuit together with an indicator unit in such a way that when the circuit is closed an intact membrane is indicated by the indicator unit thereby testing the presence of an intact pressure gas cartridge.

2. The inflation device of claim 1, wherein the indicator unit is configured for indicating an intact membrane on a continuous basis.

3. The inflation device of claim 1, wherein the indicator unit further comprises a switching mechanism, for activating the indicator unit, whereby an intact membrane can be indicated.

4. The inflation device according to claim 1, wherein the tip of the striking pin is flattened at an area of contact with the sealing membrane.

5. The inflation device according to claim 1, wherein the tip of the striking pin is configured in the shape of a truncated cone or a truncated pyramid.

6. The inflation device of claim 1, further comprising a spring element, which impacts upon the tip of the striking pin for driving the tip into the direction of the sealing membrane.

7. The inflation device according to claim 1, wherein the indicator unit is integrated into the electrical trigger and ignition mechanism for the pyrotechnic charge.

8. The inflation device of claim 7, wherein the trigger and ignition mechanism comprises an electrical switch capable of being activated by water.

9. The inflation device of claim 8, further comprising a screen wall, wherein said electrical switch comprises two electrical contacts located at a distance from each other, and wherein the screen wall is disposed between the two electrical contacts in such a manner as to prevent leaking currents.

10. The inflation device of claim 7, wherein the trigger and ignition mechanism further comprises a housing with two chambers, one chamber for disposition of an electrical switch capable of activation by water, and the other one for housing electronic parts, the indicator unit, and batteries and storage batteries.

11. The inflation device of claim 1, wherein the trigger and ignition mechanism further comprises test circuitry and an indicator for supplying a test current or a test voltage to the pyrotechnic charge for so indicating the presence of an intact pyrotechnic charge or the absence thereof.

12. The inflation device of claim 11, wherein the test switching circuit and the test circuitry for testing the presence of the sealing membrane are connected to the same indicator unit.

13. The inflation device of claim 11, wherein the test switching circuit and the test circuitry for indicating the sealing membrane are connected to separate indicator units.

14. The inflation device of claim 11, wherein switching means are configured for testing the presence of the pressure gas cartridge and the pyrotechnic charge.

* * * * *